US007603951B2

(12) United States Patent
Rose et al.

(10) Patent No.: US 7,603,951 B2
(45) Date of Patent: Oct. 20, 2009

(54) REACTIVE MATERIAL ENHANCED PROJECTILES AND RELATED METHODS

(75) Inventors: Michael T. Rose, Tremonton, UT (US); Daniel W. Doll, Marriott Slaterville, UT (US); James R. Hodgson, Newton, UT (US); Robert K. Goodell, Honeyville, UT (US); Randall T. Busky, Independence, MO (US); Edward J. Bray, II, Overland Park, KS (US); Daniel B. Nielson, Tremonton, UT (US)

(73) Assignee: Alliant Techsystems Inc., Minneapolis, MN (US)

( * ) Notice: Subject to any disclaimer, the term of this patent is extended or adjusted under 35 U.S.C. 154(b) by 461 days.

(21) Appl. No.: 11/079,925

(22) Filed: Mar. 14, 2005

(65) Prior Publication Data

US 2006/0011086 A1 Jan. 19, 2006

Related U.S. Application Data

(60) Provisional application No. 60/553,430, filed on Mar. 15, 2004.

(51) Int. Cl.
*F42B 12/44* (2006.01)

(52) U.S. Cl. ..... 102/364; 102/473; 102/500; 102/501; 102/517

(58) Field of Classification Search ..... 102/499, 102/500, 364, 439, 473, 477, 501, 506, 507, 102/508, 509, 510, 517
See application file for complete search history.

(56) References Cited

U.S. PATENT DOCUMENTS 1,819,106 A 8/1931 McBride et al.

(Continued)

FOREIGN PATENT DOCUMENTS

DE 315857 6/1920

(Continued)

OTHER PUBLICATIONS

U.S. Appl. No. 10/801,948, filed Mar. 15, 2004, for Reactive Material Enhanced Munition Compositions and Projectiles Containing Same, by Nielson et al.

(Continued)

*Primary Examiner*—James S Bergin
(74) *Attorney, Agent, or Firm*—TraskBritt

(57) ABSTRACT

A projectile having a reactive material disposed therein is provided. The projectile includes a housing which defines a cavity, the cavity being open at one end of thereof. A reactive material is disposed within the cavity. A tip is coupled with the housing and substantially encloses the opening of the cavity. The housing, the reactive material and the tip are cooperatively positioned and configured so as to define a void space between a surface of the tip and a surface of the reactive material. Upon impact with a target, the tip of the projectile is designed to become displaced within the cavity until it contacts the reactive material and transfers kinetic energy thereto, thereby causing ignition of the reactive material. The void space may be defined to provide a desired amount of time between initial impact of the projectile with a target and the subsequent ignition of the reactive material.

11 Claims, 4 Drawing Sheets

U.S. PATENT DOCUMENTS

| | | | | | |
|---|---|---|---|---|---|
| 2,326,147 | A | * | 8/1943 | Landen | 102/500 |
| 2,359,317 | A | * | 10/1944 | Landen | 102/500 |
| 2,398,287 | A | | 4/1946 | Christie | |
| 2,424,970 | A | * | 8/1947 | Church et al. | 102/500 |
| 2,425,418 | A | * | 8/1947 | Burdett et al. | 102/499 |
| 2,446,268 | A | | 8/1948 | Dawson | |
| 2,459,175 | A | * | 1/1949 | Moore | 102/499 |
| 2,703,531 | A | | 3/1955 | Graumann et al. | |
| 3,434,420 | A | | 3/1969 | Ciccone et al. | |
| 3,730,093 | A | | 5/1973 | Cummings | |
| 4,006,687 | A | | 2/1977 | Ridgeway | |
| 4,094,246 | A | | 6/1978 | Travor | |
| 4,096,804 | A | * | 6/1978 | Bilsbury | 102/364 |
| 4,131,498 | A | | 12/1978 | Lucy | |
| 4,237,787 | A | | 12/1980 | Wacula et al. | |
| 4,280,408 | A | | 7/1981 | Weber et al. | |
| 4,383,485 | A | * | 5/1983 | Coates et al. | 102/364 |
| 4,419,936 | A | | 12/1983 | Coates et al. | |
| 4,572,077 | A | | 2/1986 | Antoine et al. | |
| 4,612,860 | A | | 9/1986 | Flatau | |
| 4,662,280 | A | | 5/1987 | Becker et al. | |
| 4,958,570 | A | | 9/1990 | Harris | |
| 4,970,960 | A | | 11/1990 | Feldmann | |
| 5,121,691 | A | * | 6/1992 | Nicolas | 102/364 |
| 5,175,392 | A | | 12/1992 | Denis | |
| 5,198,616 | A | | 3/1993 | Anderson | |
| 5,347,907 | A | * | 9/1994 | Strandli et al. | 86/20.14 |
| 5,652,408 | A | * | 7/1997 | Nicolas | 102/499 |
| 5,945,629 | A | | 8/1999 | Schildknecht et al. | |
| 6,105,505 | A | | 8/2000 | Jones | |
| 6,119,600 | A | | 9/2000 | Burri | |
| 6,484,642 | B1 | | 11/2002 | Kuhns et al. | |
| 6,799,518 | B1 | | 10/2004 | Williams | |
| 6,846,372 | B1 | | 1/2005 | Guirguis | |
| 7,191,709 | B2 | | 3/2007 | Nechitailo | |
| 7,380,503 | B2 | | 6/2008 | Williams et al. | |
| 2003/0140811 | A1 | | 7/2003 | Bone | |
| 2005/0067072 | A1 | | 3/2005 | Vavrick | |
| 2005/0199323 | A1 | * | 9/2005 | Nielson et al. | 149/19.3 |

FOREIGN PATENT DOCUMENTS

| | | | | |
|---|---|---|---|---|
| DE | 3240310 | A | * | 6/1983 |
| DE | 3240310 | A1 | | 6/1983 |
| FR | 856233 | | | 6/1940 |
| GB | 488909 | A | | 7/1938 |
| GB | 1 591 092 | A | | 6/1981 |
| RU | 2100763 | C1 | | 12/1997 |

OTHER PUBLICATIONS

UK Search Report of Jun. 8, 2005.

Search Report dated Nov. 8, 2005, prepared by the EPO for the French Patent Office.

English translation of previously cited French Patent No. FR 856233, Jun. 7, 1940.

English translation of previously cited German Patent No. DE 315857, Jun. 28, 1920.

English Translation of German Patent DE 32 40 310 A1 to Jenus Jun, published Jun. 1, 1983.

PCT International Search Report mailed Jul. 28, 2008, for International Application No. PCT/US2007/076672.

* cited by examiner

REACTIVE MATERIAL ENHANCED PROJECTILES AND RELATED METHODS

CROSS-REFERENCE TO RELATED APPLICATION

The present application claims the benefit of U.S. Provisional Application Ser. No. 60/553,430 entitled REACTIVE MATERIAL ENHANCED PROJECTILES AND RELATED METHODS filed on Mar. 15, 2004, the disclosure of which is incorporated by reference herein in its entirety.

STATEMENT OF GOVERNMENT INTEREST

The United States Government has certain rights in the present invention pursuant to Contract No. N00178-01-D-1015 between the United States Navy and ATK Thiokol, a subsidiary of Alliant Techsystems Inc., and Contract No. DAAe30-01-9-0800 between the United States Army and ATK Thiokol, a subsidiary of Alliant Techsystems Inc.

BACKGROUND OF THE INVENTION

1. Field of the Invention

The present invention is related to reactive material enhanced projectiles and, more particularly, to projectiles including incendiary or explosive compositions, the projectiles having improved stabilization characteristics and control over the ignition of the composition.

2. State of the Art

There are numerous designs of projectiles containing incendiary or explosive compositions. Such projectiles are conventionally configured such that the incendiary or explosive composition becomes ignited upon, or shortly after, the projectile's contact with a target. Ignition of the incendiary or explosive composition is intended to inflict additional damage on the intended target. Aside from the additional damage that might result from the pressure of the explosion, the burning of the composition, or both, often, ignition of the incendiary or explosive composition is accompanied by fragmentation of the projectile casing thereby providing additional shrapnel-like components which spread out to create a larger area of impact and destruction.

Some exemplary projectiles containing an incendiary or explosive composition are described in U.S. Pat. No. 4,419,936 to Coates et al., the disclosure of which is incorporated by reference herein in its entirety. The Coates patent generally discloses a ballistic projectile having one or more chambers containing a material which is explosive, hypergolic, incendiary or otherwise reactive or inert. The material may be a liquid, a semi-liquid, a slurry or of solid consistency. Initially, the material is hermetically sealed within a casing of the projectile but is released when the projectile impacts with a target and the projectile casing is concomitantly fragmented.

In many cases, projectiles containing an incendiary or explosive composition are designed to provide increased penetration of the projectile into a given target such as, for example, an armored vehicle. One such projectile is the MK211 armor piercing incendiary (API), a projectile which is configured for penetration of armor plating. However, the MK211 and similar projectiles have proven to be relatively ineffective against what may be termed thin-skinned targets. Thin-skinned targets may include, for example, liquid filled fuel tanks or other similar structures having a wall thickness of, for example, about 6 millimeters (mm) (about 0.25 inch) or less.

Use of conventional APIs or other projectiles configured for penetration of armored structures often fail to inflict any damage on thin-skinned targets other than the initial penetration opening. This is often because the projectiles are configured as penetrating structures with much of the projectile being dedicated to penetrating rods or other similar structures. As such, these types of projectiles contain a relatively small amount of incendiary or explosive composition therein because the volume needed for larger amounts of such material is consumed by the penetrating structure. Thus, containing relatively small amounts of incendiary or explosive materials, the resultant explosions or reactions are, similarly, relatively small. Additionally, because the incendiary or explosive composition is configured to ignite substantially simultaneously with the impact of the projectile and a target, the explosion or other reaction is often complete before it can inflict substantial additional damage to the target (such as ignition of leaking fuel from a fuel tank).

An exemplary projectile designed for discrimination between an armored-type target and a thin-skinned target includes that which is described in U.S. Patent Application Publication Number 20030140811. The projectile disclosed by this publication includes one or more sensors, such as a piezoelectric crystal, which are configured to determine the rate of deceleration of the projectile upon impact with a target. The rate of deceleration of the projectile will differ depending on whether an armored-type target or a thin-skinned target is being struck. For example, the rate of deceleration of the projectile will be relatively greater (i.e., it will decelerate more quickly) if the projectile strikes an armored target than if it strikes a thin-skinned target. Upon determining the rate of deceleration, a fuse will ignite an incendiary or explosive composition at an optimized time in order to effectively increase the damage to the specific target depending on what type of target is being impacted.

While the projectile disclosed in the US 20030140811 publication reference provides an incendiary or explosive projectile which may provide some effectiveness against thin-skinned targets, the projectile disclosed thereby is a complex structure requiring numerous components and would likely be expensive and difficult to fabricate.

An additional problem with conventional incendiary or explosive projectiles is the ability to control the projectile's stability and accuracy. For example, considering the projectile disclosed by the above-described Coates patent wherein the incendiary/explosive material is in the form of a liquid, the liquid and surrounding casing will likely exhibit differing angular velocities at any given time, particularly when the casing is rapidly changing its angular velocity such as upon initial firing or upon initial impact of a target. The independent angular velocities of the liquid material and casing can affect the overall stability of the projectile during flight and, ultimately, affect the projectile's accuracy, particularly over long ranges. Of course, such discrepancy in angular velocities can occur when other incendiary or explosive compositions, including solid compositions, are housed within the projectile's casing.

In view of the shortcomings in the art, it would be advantageous to provide a projectile comprising a reactive material in the form of an incendiary, explosive or pyrotechnic composition wherein the projectile may be tailored for proper ignition of the reactive material contained therein depending on the nature of an intended target while maintaining a simple, robust and yet relatively inexpensive structural design. Additionally, it would be an advantage to provide an explosive or incendiary projectile which exhibits increased stability and accuracy.

BRIEF SUMMARY OF THE INVENTION

In accordance with one aspect of the invention, a projectile is provided. The projectile includes a housing having a cavity defined therein, the cavity being open at one end of the housing. A reactive material is disposed within the cavity. A tip is coupled with the housing and substantially closes the opening of the cavity. The housing, the reactive material and the tip are cooperatively positioned and configured to define a void space between a surface of the tip and a surface of the reactive material.

The projectile may further include one or more recesses formed within a surface of the housing adjacent the cavity. The recesses, or other surface features which may be used, provide added securement between the reactive composition and the housing in order to prevent slippage therebetween and differential angular momentum between the reactive composition and the tip and housing assembly upon firing of the projectile.

In accordance with another embodiment of the present invention, a method of timing the ignition of a reactive material disposed within a projectile is provided. The projectile includes a housing, in which the reactive material is disposed, and a tip coupled with the housing. The method includes providing a defined distance, or standoff, between a directionally trailing surface of the tip and a directionally leading surface of the reactive material. When the projectile is impacted upon a target, the tip of the projectile is displaced rearwardly with respect to the housing such that the directionally trailing surface of the tip contacts the directionally leading surface of the reactive material. Kinetic energy from target impact is transferred to the reactive material through the displaced tip, causing the ignition thereof. The defined distance, or standoff, may be tailored depending, for example, on the type of intended target (e.g., armored vs. thin-skinned) and the desired reaction initiation time delay for ignition of the reactive material after target impact.

In accordance with yet another aspect of the present invention, a method of fabricating a projectile is provided. The method includes providing a housing and defining a cavity within the housing including an opening at one end of the housing. A mass of reactive material is disposed within the cavity. A tip is coupled to the housing to close the opening, and the tip, the housing and the reactive material are cooperatively positioned and configured so as to define a void space between a surface of the tip and a surface of the reactive material.

In accordance with a further aspect of the present invention, a method of timing the ignition of a reactive material disposed within a projectile is provided wherein the projectile includes a housing and a tip coupled with the housing. The method includes forming a rear housing portion for the projectile with a cavity therein and an open, forward-facing mouth and a selected volume of reactive material is disposed within the cavity. A projectile tip is placed into the mouth of the cavity and secured to the rear housing portion with a rearward-facing surface of the projectile tip located a defined distance, the defined distance being selected to, at least in part, determine a time delay between impact of the projectile tip and a target and initiation of the reactive material by contact of the rearward-facing surface of the projectile tip therewith.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
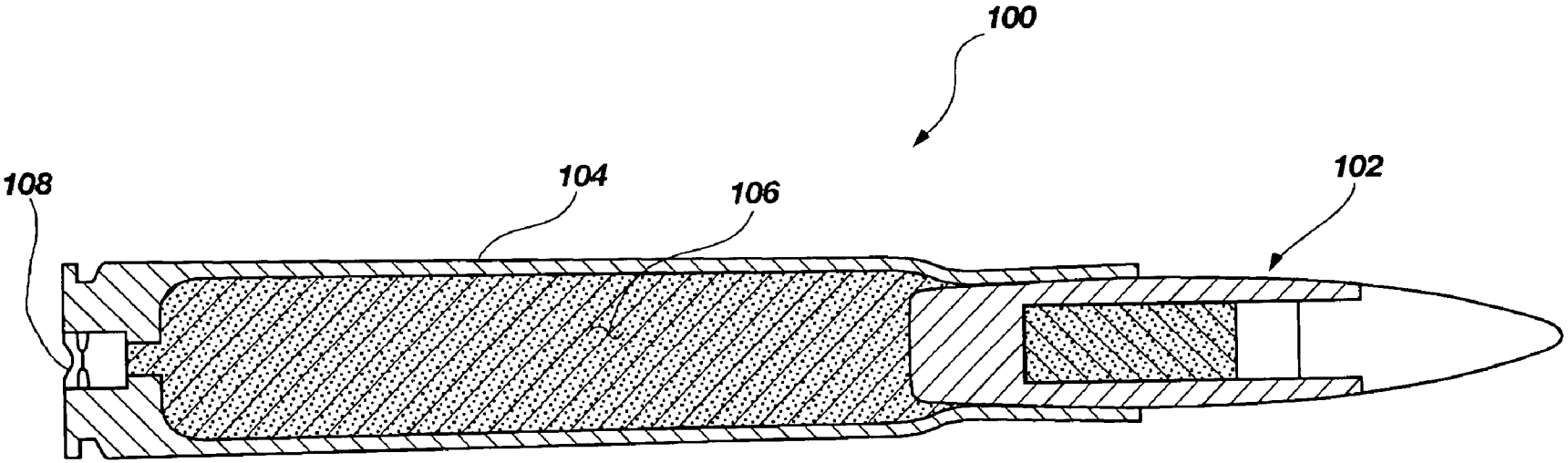
FIG. 1 is a partial cross-sectional side view of a cartridge containing a projectile in accordance with an exemplary embodiment of the present invention.

Referring to FIG. 1, an assembled cartridge 100 having a projectile 102 in accordance with one embodiment of the present invention is shown. The cartridge 100 includes a cartridge casing 104 containing, for example, gun powder or another appropriate propellant composition 106. An initiating or detonation device 108, commonly termed a primer, is in communication with, and configured to ignite, the propellant composition 106. The projectile 102 is coupled with the cartridge casing 104 such as, for example, by mechanically press-fitting the projectile 102 into an end of the cartridge casing 104.

Upon actuation of the detonation device 108, such as by a firing pin of a gun or other artillery weapon (none shown), the detonation device 108 ignites the propellant composition 106 causing the projectile 102 to be expelled from the cartridge casing 104 and from the barrel of a gun, or other weapon in which the cartridge 100 is housed, at a very high rate of speed. For example, in one embodiment, the cartridge 100 may be designed as a .50 caliber round (meaning that the cartridge is designed to be fired from a weapon having a bore diameter of approximately .50 inch or approximately 13 mm) wherein the projectile 102 may exhibit a muzzle velocity (the velocity of the projectile as it leaves the "muzzle" or barrel of a weapon) of approximately 760 to 915 meters per second (approximately 2,500 to 3,000 feet per second).

Figure 2:
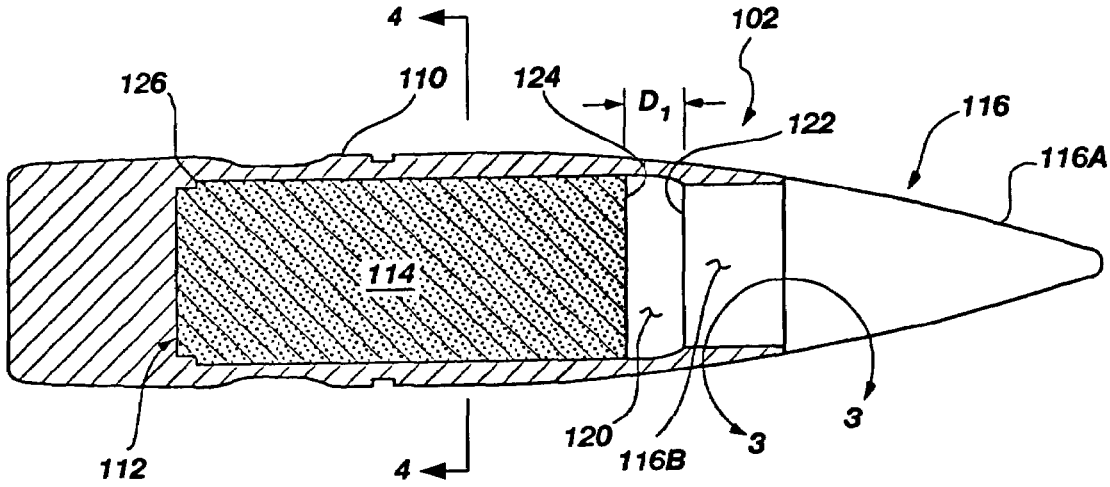
FIG. 2 is an enlarged partial cross-sectional side view of the projectile shown in FIG. 1.
Figure 3:
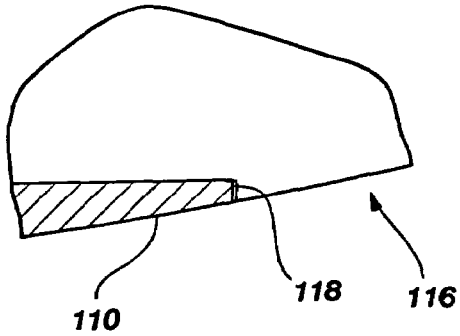
FIG. 3 is an enlarged detail of a portion of the projectile shown in FIG. 2.

Referring now to FIG. 2, an enlarged cross-sectional view of the projectile 102 is shown. The projectile 102 includes a rear housing portion 110 defining a cavity 112 therein, the cavity 112 being open at a forward end of the rear housing portion 110. An appropriate incendiary, explosive, pyrotechnic or other reactive material (hereinafter referred to as a reactive material 114 for purposes of convenience) is disposed within the cavity 112. A tip 116 includes a shaped, forward portion 116A and an aft portion 116B, which is sized and configured for coupling with the rear housing portion 110 of the projectile 102 to close the open end or mouth of the cavity 112. For example, the aft portion 116B of the tip 116 may be sized to be press-fit into the cavity 112 of the rear housing portion 110. Additionally, referring to FIG. 3 in conjunction with FIG. 2, the tip 116 may include a shoulder 118 which is configured to axially abut a surface of the rear housing 112, providing a positive stop between the tip 116 and rear housing 112 when the projectile 102 is initially assembled.

Still referring to FIG. 2, a void space 120, also referred to as an ullage, may be defined between the aft portion 116B of the tip 116 and the reactive material 114. The void space 120 may be configured such that a specified distance $D_1$ is defined between the directionally trailing surface 122 of the aft portion 116B of the tip 116 and the directionally leading surface 124 of the reactive material 114. As will be discussed in further detail hereinbelow, the void space 120 may be used to strategically define the amount of time delay between impact of the projectile 102 with a target and initiation of the reactive material 114.

Figure 4:
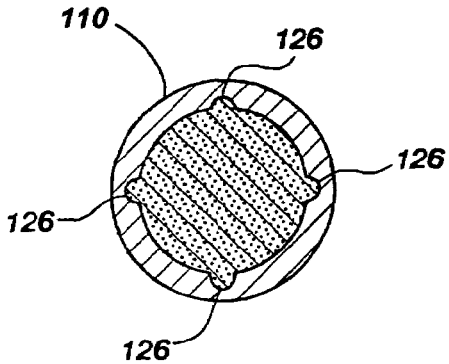
FIG. 4 is a cross-sectional view of the projectile as taken along the indicated lines in FIG. 2.

In some embodiments, the cavity 112 formed in the rear housing portion 110 may include one or more grooves or flutes 126 along a lateral periphery thereof. For example, in the embodiment shown in FIGS. 2 and 4, a plurality of substantially longitudinally extending grooves 126 are formed in the interior surface of the rear housing portion 110 adjacent the cavity 112. The grooves 126 may be incorporated into the wall of the rear housing portion 110 surrounding the recess 112 to provide improved securement of the reactive material 114 within the cavity 112 and to reduce or, even prevent, slippage of the reactive material 114 relative to the rear housing portion 110 of the projectile 102 during travel thereof. In other embodiments, other surface discontinuities may be used including, for example, discrete recesses or indentations, protrusions, roughened surface finishes or a combination thereof.

In many cases, the projectile 102 is fired from a barrel or muzzle which has rifling grooves formed therein. As will be appreciated by those of ordinary skill in the art, rifling grooves impart a rotational motion to the projectile 102 during travel through the barrel which generally improves the accuracy of the projectile 102 after leaving the barrel. Thus, during flight of the projectile 102, there exists a possibility of slippage occurring between the interfacing surfaces of the rear housing portion 110 and the reactive material 114 contained within the cavity 112. If slippage does occur, the rear housing portion 110 will rotate at a first angular velocity and the reactive material 114 may rotate at a second angular velocity different from the first. Such a situation reduces the stability and accuracy of the projectile 102.

Additionally, the recesses or flutes 126 may be sized, positioned and configured to assist in the fragmentation of the projectile 102, more particularly the rear housing portion 110 thereof, upon impact of the projectile with a target and the ignition of the reactive material 114. For example, it may be desirable to enhance the fracturing of the rear housing portion 110 such that an explosion, resulting from ignition of the reactive material 114, occurs at a desired time and in a desired manner when the projectile 102 strikes a thin-skinned target such as a fuel tank. Thus, the number of grooves 126 or other surface features, as well as their size and location within the cavity 112, may be tailored according to the desired destructive effect to be provided by the projectile 102 taking into account the type of target the projectile is intended to strike.

Moreover, the size, shape and configuration of flutes 126 or other surface discontinuities may be specifically tailored to control the timing of the fragmentation of the projectile 102. For example, by providing a greater number of the recesses or flutes 126 within the rear housing portion 110, or by providing the recesses or flutes 126 with a relatively greater radial depth, allows for easier breach of the rear housing portion 110 by an ignited reactive material 114. Thus, with a relatively "weaker" delivery vehicle (i.e., the rear housing portion 110) due to a tailored number, size and shape of the recesses or flutes 126, there will be less resistance to the reaction provided by an ignited reactive material 114 and, therefore, a faster breach of the structure. On the other hand, a relatively fewer number of recesses or flutes 126, a recess or flute 126 with a lesser radial depth in the rear housing portion 110, or both, will provide a stronger delivery vehicle with more resistance to breach thereof by an ignited reactive material 114 and, therefore, a longer period of time to achieve such a breach. Thus, the tailoring of the recesses or flutes 126 (or other surface discontinuities) may be employed for purposes of controlling fragmental ion, for controlling the time of structural breach of the projectile 102 by an ignited reactive material 114, for stabilization and spin control of the projectile 102 during flight, or for a combination of such purposes.

Still referring to FIG. 2, in one exemplary embodiment, the rear housing portion 110 and the tip 116 may be formed of a material such as brass. While it is contemplated that other materials may also be used, brass may be used, for example, when the projectile 102 is intended for thin-skinned targets because it takes less energy to deform the tip 116 of the projectile 102 upon impact of a target as compared to, for example, carbon steel. One particular embodiment may include the projectile 102 being formed as a 0.50 caliber round (as defined hereinabove). Such an embodiment may include, for example, four flutes 126 located approximately 90° from one another which exhibit a radial depth of approximately 0.015 inch (approximately 0.38 mm) and a circumferential width of approximately 0.020 inch (approximately 0.51 mm). The void space 120 may be configured using a selected value of reactive material in conjunction with a selected length of the aft portion 116B of the tip 116 such that the distance $D_1$ is approximately 0.23 inch (approximately 5.8 mm). Of course it is to be understood that the projectile 102 may be formed of different materials and may be sized larger or smaller than a .50 caliber round, include a larger or smaller void space 120, and include different surface features within the rear housing portion 110 to prevent slippage between the reactive material 114 and the rear housing portion 110, to control fragmentation, to control timing of an ignited reactive material 114 breaching the structure, or to effect some combination thereof.

Various types of reactive material 114 may be used with the projectile 102. In one embodiment, the reactive material 114 includes reactive material components from at least two of the following three component categories: at least one fuel, at least one oxidizer, and at least one class 1.1 explosive. The reactive material 114 is formulated for use in a reactive material projectile, such as a bullet, and to provide at least one of an overpressure of greater than approximately 9 pounds per square inch (approximatley 62 kilopascals) at a radial measurement of approximately 12 inches (approximately 305 mm) from a point of impact on a target, a hole greater than approximately 2 square inches (approximately 12.9 square centimeters) at an optimum penetration level in a target, and pressure, damage, and a flame when the reactive material projectile impacts a target.

The at least one fuel may be selected from the group consisting of a metal, a fusible metal alloy, an organic fuel, and mixtures thereof. A suitable metal for the fuel may be selected from the group consisting of hafnium, tantalum, nickel, zinc, tin, silicon, palladium, bismuth, iron, copper, phosphorous, aluminum, tungsten, zirconium, magnesium, boron, titanium, sulfur, magnalium, and mixtures thereof. A suitable organic for the fuel may be selected from the group consisting of phenolphthalein and hexa(ammine)cobalt(III)nitrate. A suitable, fusible metal alloy for the fuel may include at least one metal selected from the group consisting of bismuth, lead, tin, cadmium, indium, mercury, antimony, copper, gold, silver, and zinc. In one embodiment, the fusible metal alloy may have a composition of about 57% bismuth, about 26% indium, and about 17% tin.

The at least one oxidizer may be selected from the group consisting of an inorganic oxidizer, sulfur, a fluoropolymer, and mixtures thereof. The at least one oxidizer may be an alkali or alkaline metal nitrate, an alkali or alkaline metal perchlorate, or an alkaline metal peroxide. For instance, the at least one oxidizer may be ammonium perchlorate, potassium perchlorate, potassium nitrate, strontium nitrate, basic copper nitrate, ammonium nitrate, cupric oxide, tungsten oxides, silicon dioxide, manganese dioxide, molybdenum trioxide, bismuth oxides, iron oxide, molybdenum trioxide, or mixtures thereof. The at least one oxidizer may also be selected from the group consisting of polytetrafluoroethylene, a thermoplastic terpolymer of tetrafluoroethylene, hexafluoropropylene, and vinylidene fluoride, and a copolymer of vinylidenefluoride-hexafluoropropylene.

The at least one class 1.1 explosive may be selected from the group consisting of trinitrotoluene, cyclo-1,3,5-trimethylene-2,4,6-trinitramine, cyclotetramethylene tetranitramine, hexanitrohexaazaisowurtzitane, 4,10-dinitro-2,6,8,12-tetraoxa-4,10-diazatetracyclo-[5.5.0.0$^{5,9}$.0$^{3,11}$]-dodecane, 1,3,3-trinitroazetine, ammonium dinitramide, 2,4,6-trinitro-1,3,5-benzenetriamine, dinitrotoluene, and mixtures thereof. The reactive material may also include at least one binder selected from the group consisting of polyurethanes, epoxies, polyesters, nylons, cellulose acetate butyrate, ethyl cellulose, silicone, graphite, and (bis(2,2-dinitropropyl) acetal/bis(2,2-dinitropropyl) formal).

A more specific exemplary composition includes a mixture of approximately 90% hafnium by weight and approximately 10% THV fluoropolymer (a terpolymer of tetrafluoroethylene, hexafluoropropylene and vinylidene fluoride) by weight. Of course other reactive compositions may be used in conjunction with the present invention. Other exemplary reactive compositions which may be used with the present invention as set forth in U.S. patent application Ser. No. 10/801,948, entitled REACTIVE MATERIAL ENHANCED MUNITION COMPOSITIONS AND PROJECTILES CONTAINING SAME, assigned to the assignee hereof, the disclosure of which is incorporated by reference herein in its entirety.

Figure 5:
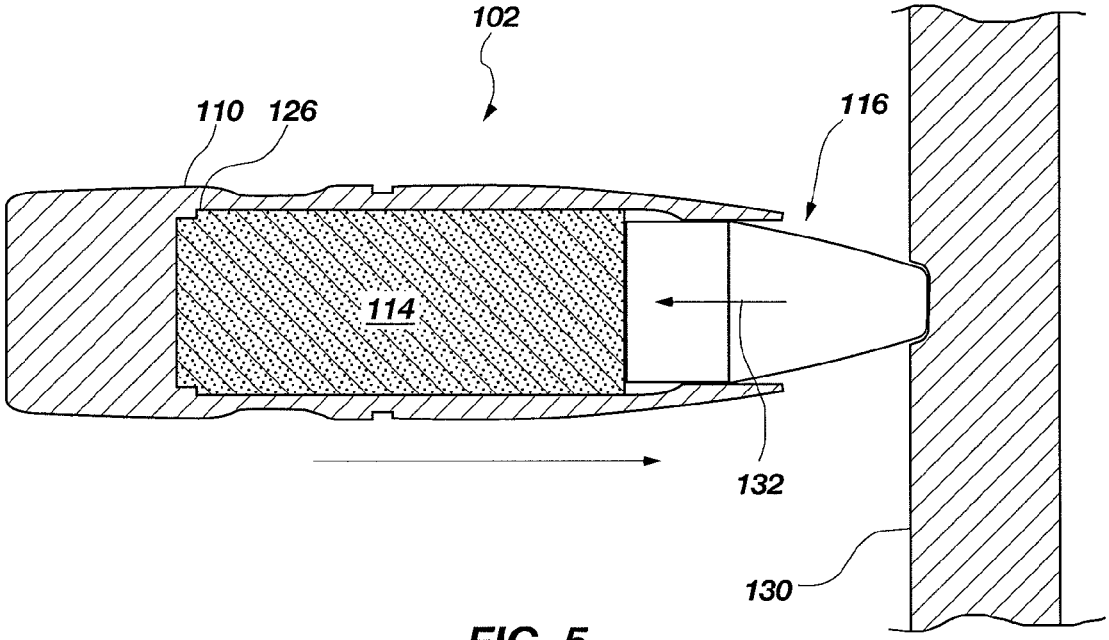
FIG. 5 is a partial cross-sectional side view of the projectile shown in FIG. 2 during impact with a target.

Referring now to FIG. 5, the projectile 102 is shown upon impact with a target 130. As the projectile 102 strikes the target 130, a number of things occur. The tip 116 of the projectile 102 may experience an amount of deformation upon impact with the target 130. Similarly, the wall of the target 130 experiences some deformation as the projectile 102 penetrates the target 130. Additionally, upon impact with the target 130, the tip 116 of the projectile 102 is displaced rearwardly into the cavity 112. In other words, the tip 116 becomes displaced relative to the rear housing portion 110 as indicated by directional arrow 132.

It is noted that, in order for the tip 116 to become displaced into the cavity 112 of the rear housing portion 110, some deformation of the rear housing portion 110, the tip 116 (such as along the shoulder 118—shown in FIG. 3), or both will occur. Thus, it is desirable to design the interface of the tip 116 and rear housing portion 110, including the shoulder 118 or other structure, to yield and allow such relative displacement upon application of a determined dynamic force to the tip 116. In designing such an interface, one may take into account the types of materials being used, the wall thickness of rear housing portion 110, the size and number of flutes 126 or other surface discontinuities on the interior of the rear housing portion 110, the shape of the tip 116, the type of intended target (e.g., thin-skinned vs. armored), the mass of the projectile 102 and the anticipated speed or range or possible speeds of the projectile 102 upon impact with an intended target.

The displacement of the tip 116 relative to the rear housing 110 causes the tip 116 to impact reactive material 114. The reactive material 114 is ignited either through the transfer of kinetic energy to the reactive material 114 upon impact of the tip 116 therewith, through an adiabatic compression potential of the gas trapped in the void space 120 (FIG. 2) which causes an increase of temperature on the surface of reactive material 114, or through a combination of both events. Ignition of the reactive material 114 causes the rear housing portion 110 to burst and may produce a plume of fire with an associated pressure shock. The ignition of the reactive material 114 causes additional damage to the intended target. For example, if the intended target is a fuel tank, the initial penetration of the projectile 102 may cause fuel to escape from the fuel tank and vaporize while ignition of the reactive material 114 may then cause ignition of the vaporized fuel and explosion of the fuel tank.

With reference to both FIGS. 2 and 5, it is noted that the void space 120 shown in FIG. 2 is eliminated upon displacement of the tip 116 relative to the rear housing portion 110 as shown in FIG. 5. The void space 120 may be advantageously tailored such that the distance $D_1$, and the attendant volume of the void space 120, helps to determine the amount of time delay between initial impact of the projectile 102 with a target 130 and the ignition of the reactive material 114. For example, the inventors presently believe that the volume of the void space 120 helps to determine the amount of adiabatic compression potential of the gas trapped in the void space 120. The adiabatic compression may result in a temperature increase thereby affecting the time delay in the initiating ignition of the reactive material 114. In addition to tailoring the void space 120 to produce a desired reaction time, other features suitable for adjusting the time delay may be designed in conjunction with the void space 120 such as the interfacing structure formed between the shoulder 118 of the tip 116 and its engagement with the rear housing portion 110 such as been described hereinabove.

Figure 6:
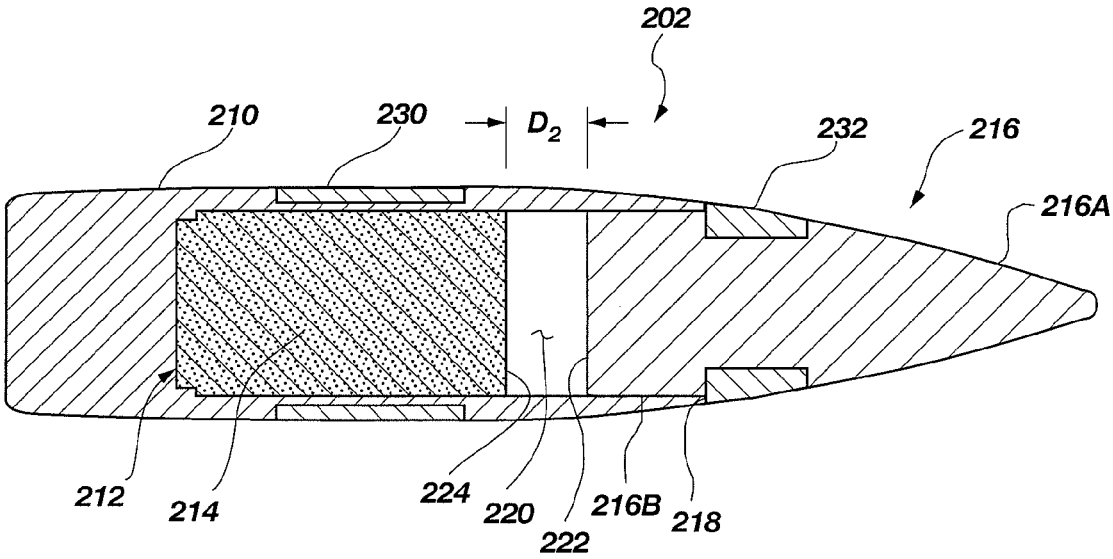
FIG. 6 is a partial cross-sectional view of a projectile in accordance with another exemplary embodiment of the present invention.

Referring now to FIG. 6, another projectile 202 is shown in accordance with another embodiment of the present invention. The projectile 202 includes a rear housing portion 210 defining a cavity 212 therein. An appropriate incendiary, explosive, pyrotechnic or other reactive material 214 is disposed within the cavity 212. A tip 216 includes a shaped, tapered, forward portion 216A and an aft portion 216B, which is sized and configured for coupling with the rear housing portion 210 of the projectile 202. For example, the aft portion 216B may be sized to be press-fit into the cavity 212 of the rear housing portion 210. Additionally, the tip 216 may include a shoulder 218 or other physical structure configured to axially abut a surface of the rear housing portion 210, providing a positive stop between the tip 216 and rear housing portion 210 when the projectile 202 is initially assembled.

A void space 220 or ullage may be defined between the aft portion 216B of the tip 216 and the reactive material 214. The void space 220 may be configured such that a specified distance $D_2$ is defined between the rear surface 222 of the aft portion 216B of the tip 216 and the forward surface 224 of the reactive material 214. The void space 220 may be used to strategically define the amount of time delay between impact of the projectile 202 with a target and ignition of the reactive material 214 upon displacement of the tip 216 into the cavity 212 and the associated transfer of kinetic energy from the tip 216 to the reactive material 214, upon adiabatic compression of gas within the void space 220, or through a combination of such events.

In some embodiments, while not specifically shown, the cavity 212 formed in the rear housing portion 210 may include one or more grooves or other surface features such as described in conjunction with the embodiment shown and described with respect to FIG. 2. The projectile 202 shown in FIG. 6 also includes a first jacket 230 disposed about the rear housing portion 210 (or a portion thereof) and a second jacket 232 disposed about the tip 216 (or a portion thereof).

In one embodiment, the rear housing portion 210 and tip 216 are formed of a first material exhibiting a first hardness while the first and second jackets 230 and 232, respectively, are formed of a second material exhibiting a second hardness, which is less than that of the first material. For example, in one particular embodiment, the rear housing portion 210 and the tip 216 may be formed of steel while the first and second jackets 230 and 232 maybe formed of brass. Such an embodiment enables the projectile 202 to penetrate a robust target such as an armored target, more effectively than a projectile entirely or largely formed of, for example, brass. The first jacket 230 may be used to interface with the inside surface of the muzzle or barrel of a firing weapon and, more particularly with rifling grooves formed therein to avoid damage thereto while enhancing the interaction between the rifling grooves and the projectile. The second jacket 232 provides a softer, more yielding and deformable material at the interface between the tip 216 and the rear housing portion 210. Such a structure enables more efficient and rapid displacement of the tip 216 within the cavity 212 upon impact of the projectile 202 with a target.

It is noted that, with the projectile 202 being designed to provide increased penetration capability (such as may be needed for an armored target), the void space 220 may be appropriately tailored in a manner described hereinabove to produce an increased time delay for initiation of reactive material 214 so that it does not initiate prematurely. Similarly, the projectile 202 may be configured to control the amount of time before an ignited reactive material will breach the structure of the projectile 202 as also discussed hereinabove. Thus, in one example, assuming the projectile 202 is configured as a .50 caliber round (as defined hereinabove), the distance $D_2$ may be approximately 0.575 inch (approximately 14.6 mm).

Figure 7:
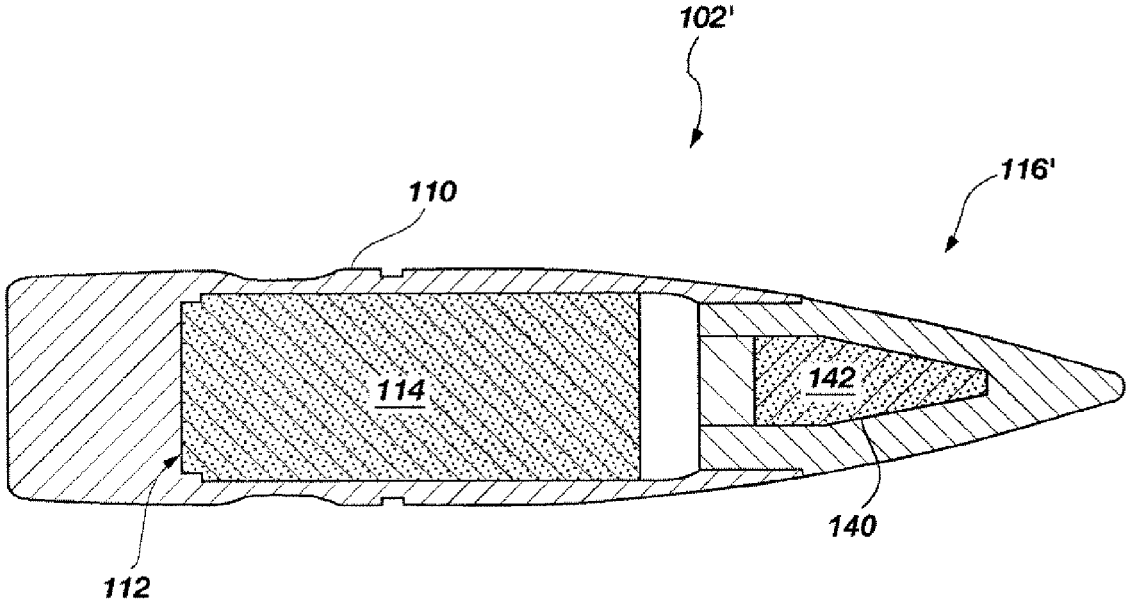
FIG. 7 is a cross-sectional view of a projectile in accordance with yet another exemplary embodiment of the present invention.

Referring now to FIG. 7, another projectile 102' is shown in accordance with yet another embodiment of the present invention. The projectile 102' is configured generally similar to the projectile 102 shown and described with respect to FIG. 2. For example, the projectile 102' includes a rear housing portion 110 which defines a cavity therein 112, the cavity being filled with a reactive material 114. A tip 116' is coupled with the rear housing portion 110. The tip 116' also defines a cavity 140 therein and the cavity is filled with a reactive material 142, which may include an incendiary, explosive or pyrotechnic composition. Thus, the projectile 102' is configured such that an initial explosion may occur by kinetically igniting the reactive material 142 in the tip 116' and a subsequent explosion may occur by kinetically or otherwise igniting the reactive material 114 in the cavity 112 of the rear housing portion 110. In some cases, the reactive material 142 in the tip may be the same or similar to the reactive material 114 in the rear housing 110. In other cases, the two reactive materials 114 and 142 may be considerably different from one another.

Thus, in some embodiments one reactive material 142 may be used for enhanced ignition of the other reactive material 114. In other embodiments, the reactive material 142 in the tip 116' may be used for enhanced penetration of the projectile 102' into an armored type target while the reactive material 114 in the rear casing 110 may be for inflicting explosive or incendiary damage to the target as described hereinabove.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A projectile comprising:

a housing having a cavity defined therein, the cavity being open at one end of the housing and having a surface feature including at least one discontinuity in an interior surface of the housing that defines, at least in part, the cavity;

a reactive material disposed within the cavity, the reactive material being arranged within the cavity to cooperatively interact with the at least one discontinuity so as to resist a change in an angular velocity of the reactive material relative to an angular velocity of the housing; and a tip coupled with the housing and substantially closing the cavity at the one end of the housing;

wherein the reactive material and the tip are cooperatively positioned and configured to define a selected void space between a surface of the tip and a surface of the reactive material, and wherein the void space is sized and configured to substantially provide an intended time of ignition of the reactive material subsequent to impact of the tip with an intended target.

2. The projectile of claim 1, wherein the tip is formed of a material comprising brass.

3. The projectile of claim 1, wherein the reactive material comprises at least two materials selected from the group consisting of at least one fuel, at least one oxidizer, and at least one class 1.1 explosive.

4. The projectile of claim 1, wherein the reactive material includes at least one fuel selected from the group consisting of a metal, a fusible metal alloy, an organic fuel, and mixtures thereof.

5. The projectile of claim 1, wherein the reactive material includes at least one oxidizer selected from the group consisting of an inorganic oxidizer, sulfur, a fluoropolymer, and mixtures thereof.

6. The projectile of claim 1, wherein the reactive material includes at least one explosive material selected from the group consisting of trinitrotoluene, cyclo-1,3,5-trimethylene-2,4,6-trinitramine, cyclotetramethylene tetranitramine, hexanitrohexaazaisowurtzitane, 4,10-dinitro-2,6,8,12-tetraoxa-4,10-diazatetracyclo -[5.5.0.0$^{5,9}$.0$^{3,11}$]-dodecane, 1,3,3-trinitroazetine, ammonium dinitramide, 2,4,6-trinitro-1,3,5-benzenetriamine, dinitrotoluene, and mixtures thereof.

7. The projectile of claim 1, wherein the reactive material comprises approximately 90% hafnium by weight and approximately 10% THV fluoropolymer by weight.

8. The projectile of claim 1, wherein the at least one discontinuity includes at least one recess.

9. The projectile of claim 8, wherein the at least one recess is sized, located and configured to stimulate a desired fragmentation pattern of the housing upon ignition of the reactive material.

10. The projectile of claim 8, wherein the at least one recess is sized, located and configured to at least partially control the timing of a structural breach of the housing subsequent an ignition of the reactive material.

11. The projectile of claim 1, wherein the tip includes a shoulder that abuts a portion of the housing, the shoulder being sized and structured to yield upon application of a predefined force to the tip in the direction of the housing.

* * * * *

UNITED STATES PATENT AND TRADEMARK OFFICE

CERTIFICATE OF CORRECTION

PATENT NO. : 7,603,951 B2
APPLICATION NO. : 11/079925
DATED : October 20, 2009
INVENTOR(S) : Rose et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 927 days.

Signed and Sealed this

Fifth Day of October, 2010

David J. Kappos

David J. Kappos
*Director of the United States Patent and Trademark Office*